US005676192A

United States Patent [19]

Itabashi et al.

[11] Patent Number: 5,676,192

[45] Date of Patent: Oct. 14, 1997

[54] CAST-IN PROCESS

[75] Inventors: Fujio Itabashi; Kaoru Kamibayashi, both of Kashiwazaki; Tsutomu Saka, Wako; Akira Fujiwara, Wako; Noriyuki Yamada, Wako, all of Japan

[73] Assignee: Kabushiki Kaisha Riken, Tokyo, Japan

[21] Appl. No.: 566,605

[22] Filed: Dec. 4, 1995

[30] Foreign Application Priority Data

Dec. 5, 1994 [JP] Japan ..... 6-329256

[51] Int. Cl.[6] ..... B22D 19/08

[52] U.S. Cl. ..... 164/100; 164/103; 164/104; 164/105

[58] Field of Search ..... 164/100, 103, 164/104, 105, 106

[56] References Cited

U.S. PATENT DOCUMENTS 1,828,271 10/1931 Arnold ..... 164/104

FOREIGN PATENT DOCUMENTS 58-181464 10/1983 Japan ..... 164/105
60-115358 6/1985 Japan ..... 164/105
2 193 131 2/1988 United Kingdom .

*Primary Examiner*—Kuang Y. Lin
*Attorney, Agent, or Firm*—Armstrong, Westerman, Hattori, McLeland & Naughton

[57] ABSTRACT

In carrying out a cast-in process, a cast-in insert member is placed into a cast forming cavity in a casting mold, and a casting is conducted. The cast-in insert member has a barrier layer on its non-deposited surface for inhibiting the deposition of a molten metal. During casting, a portion of a molten metal is introduced to a heating chamber on the side of the barrier layer to come into contact with the barrier layer. Thus, the cast-in insert member can be heated not only from the side of its deposited surface, but also from the side of its non-deposited surface, thereby providing an enhanced strength of deposition of the cast-in insert member.

16 Claims, 11 Drawing Sheets

CAST-IN PROCESS

BACKGROUND OF THE INVENTION

1. Field of the Invention

The present invention relates to a cast-in process and more particularly, to an improvement in a cast-in process including the steps of placing a cast-in insert member into a cast forming cavity in a casting mold and conducting a casting.

2. Description of the Prior Art

In the prior art cast-in process, a measure of heating the cast-in insert member from the side of the cavity by a molten metal poured into the cavity is employed.

In order to firmly deposit the cast-in insert member to a cast body during casting, it is required to rapidly and sufficiently heat the cast-in insert member and to maintain the cast-in insert member in a high temperature state for a predetermined time.

However, the prior art measure suffers from a problem that the cast-in insert member is heated only from one side and hence, it is difficult to heat the insert member so as to meet the above-described requirement, resulting in a low strength of deposition of the cast-in insert member to the cast body.

SUMMARY OF THE INVENTION

It is an object of the present invention to provide a cast-in process of the above-described type, wherein the strength of deposition of the cast-in insert member to the cast body can be enhanced by employing a particular measure.

To achieve the above object, according to the present invention, there is provided a cast-in process comprising the steps of placing a cast-in insert member into a cast forming cavity in a casting mold and conducting a casting, wherein during such casting, a portion of a molten metal introduced to a non-deposited surface of the cast-in insert member, thereby heating the cast-in insert member from the sides of a deposited surface and the non-deposited surface of the cast-in insert member.

If such a measure is employed, it is possible to rapidly and sufficiently heat the cast-in insert member from both of the sides of the deposited surface and the non-deposited surface and to maintain the cast-in insert member in a high temperature state for a predetermined time. Thus, it is possible to enhance the strength of deposition of the cast-in insert member to the cast body.

The above and other objects, features and advantages of the invention will become apparent from the following description of a preferred embodiment taken in conjunction with the accompanying drawings.

DESCRIPTION OF THE PREFERRED EMBODIMENT

Figure 1:
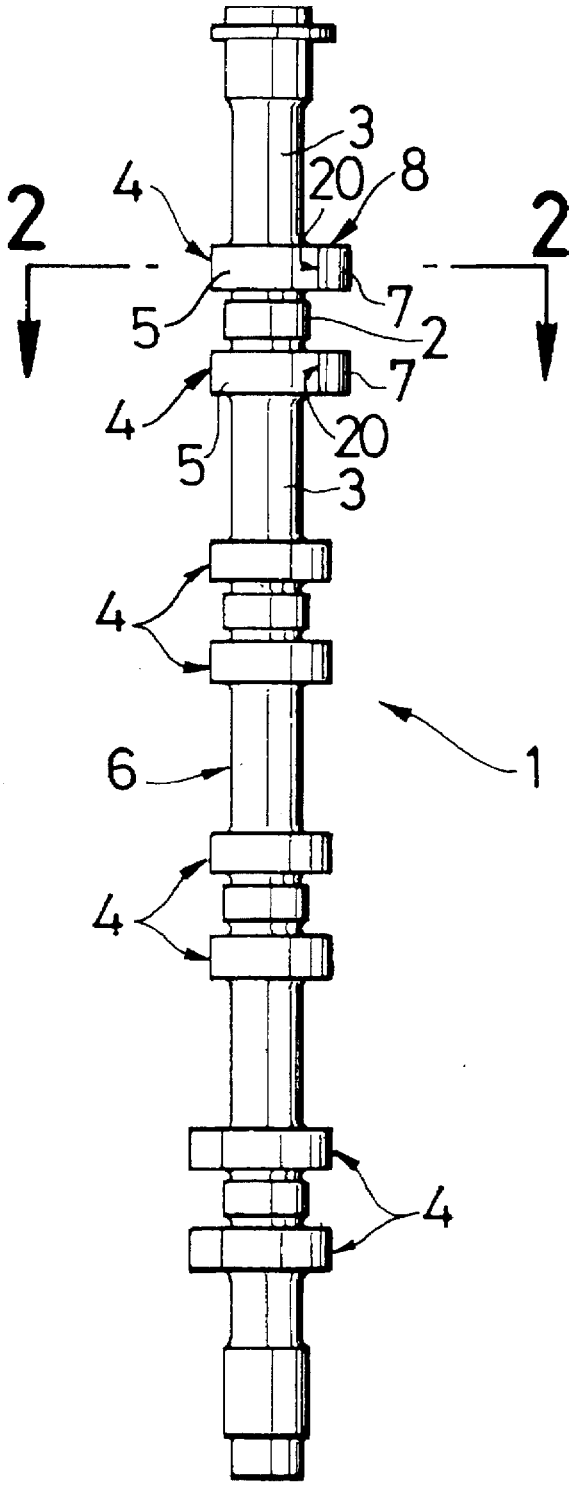
FIG. 1 is a front view of a cam shaft.
Figure 2:
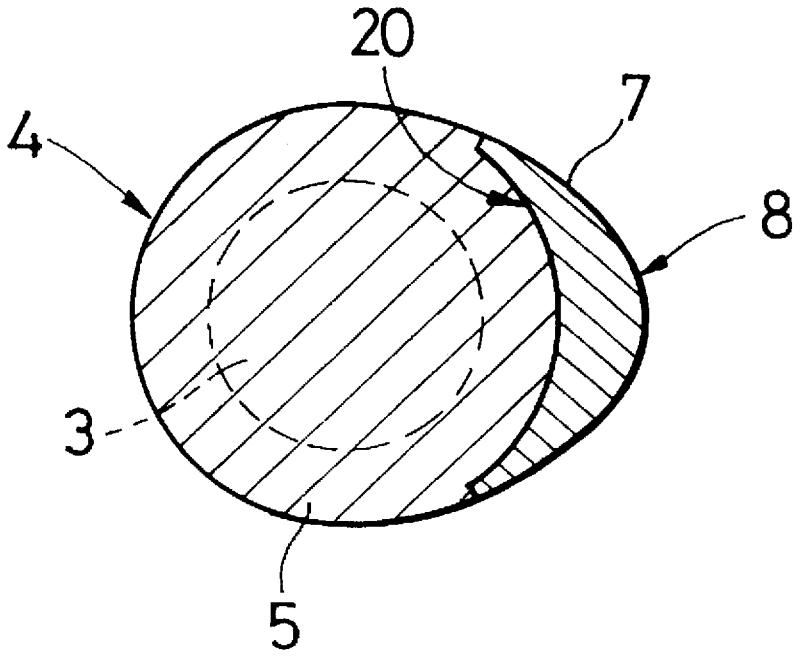
FIG. 2 is a sectional view taken along a line 2—2 in FIG. 1.

Referring to FIGS. 1 and 2, a cam shaft 1 for an internal combustion engine includes a cam shaft body 6 including a plurality of journals 2, a plurality of shaft portions 3, and base circle-portions 5 of a plurality of cams 4; and further includes a plurality of crescent-shaped sinters 8 each serving as a cast-in insert member which is deposited to the base circle-portion 5 of each cam 4 to form a nose portion 7.

The cam shaft body 6 is formed, for example, from an alloy cast iron having a good machinability and a high toughness. The sinter 8 is formed, for example, from a particle-dispersed alloy cast iron having a high hardness and an excellent wear resistance.

The cam shaft 1 is produced through a casting-in step using a shell casting mold as a casting mold shown in FIGS. 3 to 7, and the plurality of sinters 8, a chipping step, and a machining step.

Figure 3:
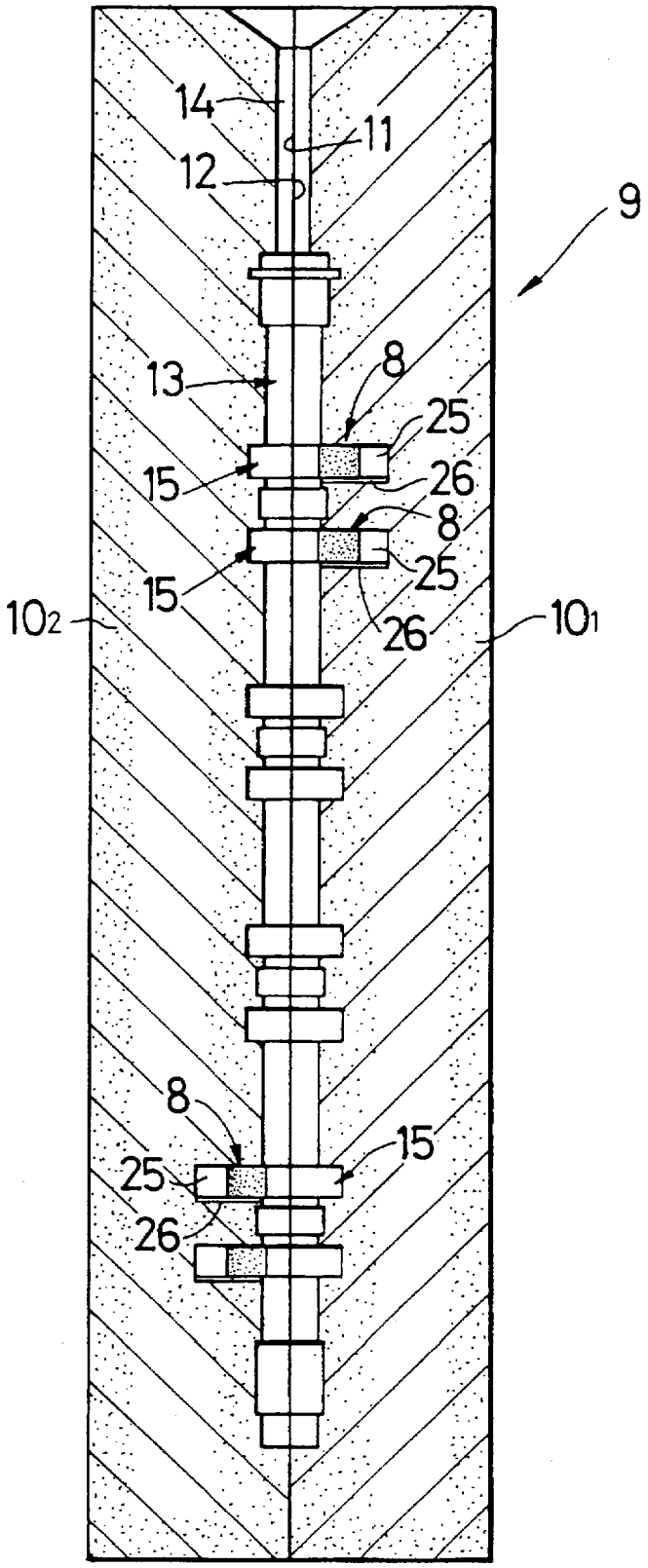
FIG. 3 is a vertical sectional view illustrating a first example of a shell casting mold.

Referring to FIG. 3, the shell casting mold 9 includes first and second split dies $\mathbf{10}_1$ and $\mathbf{10}_2$. A cam shaft blank (cast) forming cavity 13 is formed by matching mating faces 11 and 12 of the split dies $\mathbf{10}_1$ and $\mathbf{10}_2$. A gate 14 communicates with an upper end of the cavity 13.

Figure 4:
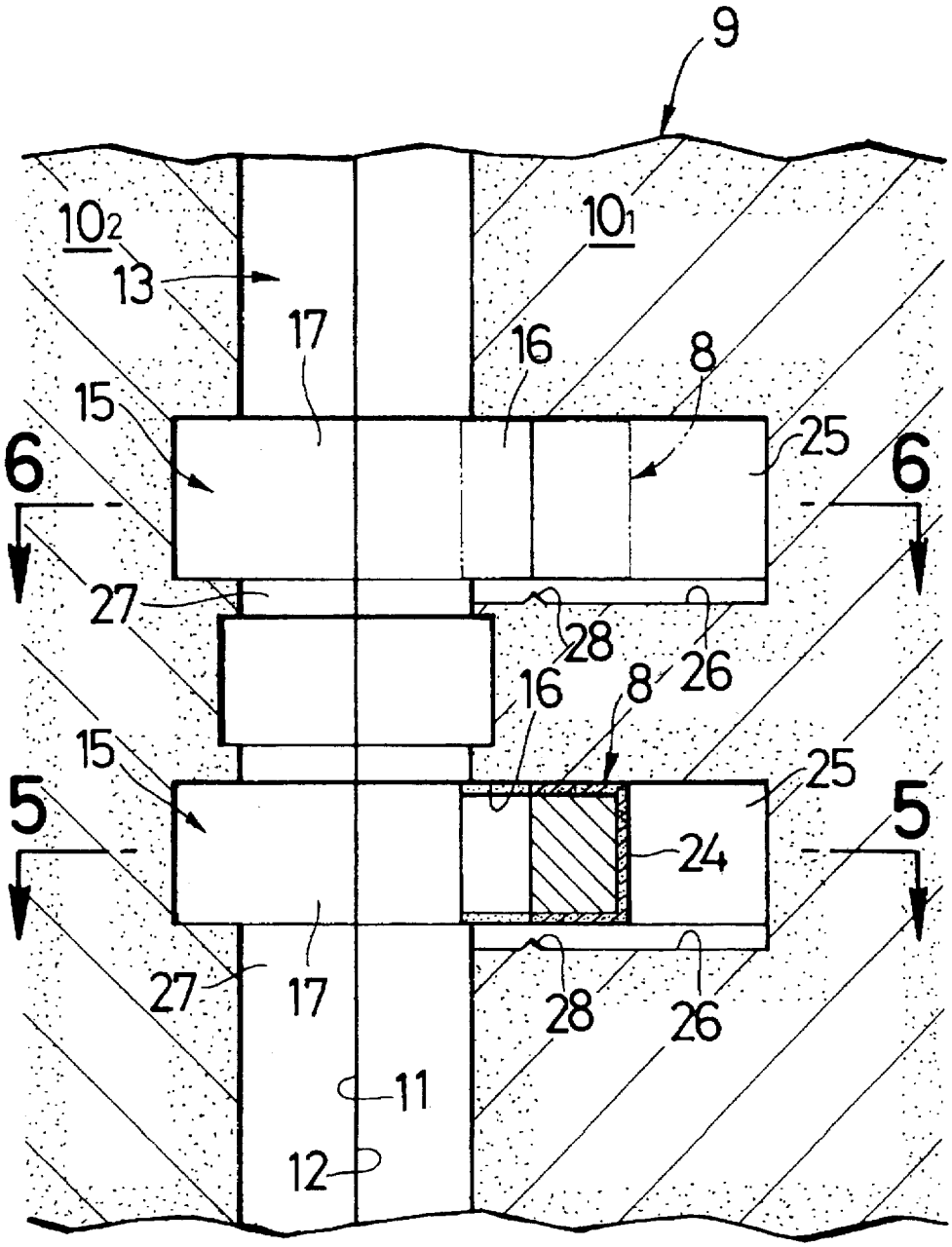
FIG. 4 is an enlarged view of an essential portion shown in FIG. 3.
Figure 5:
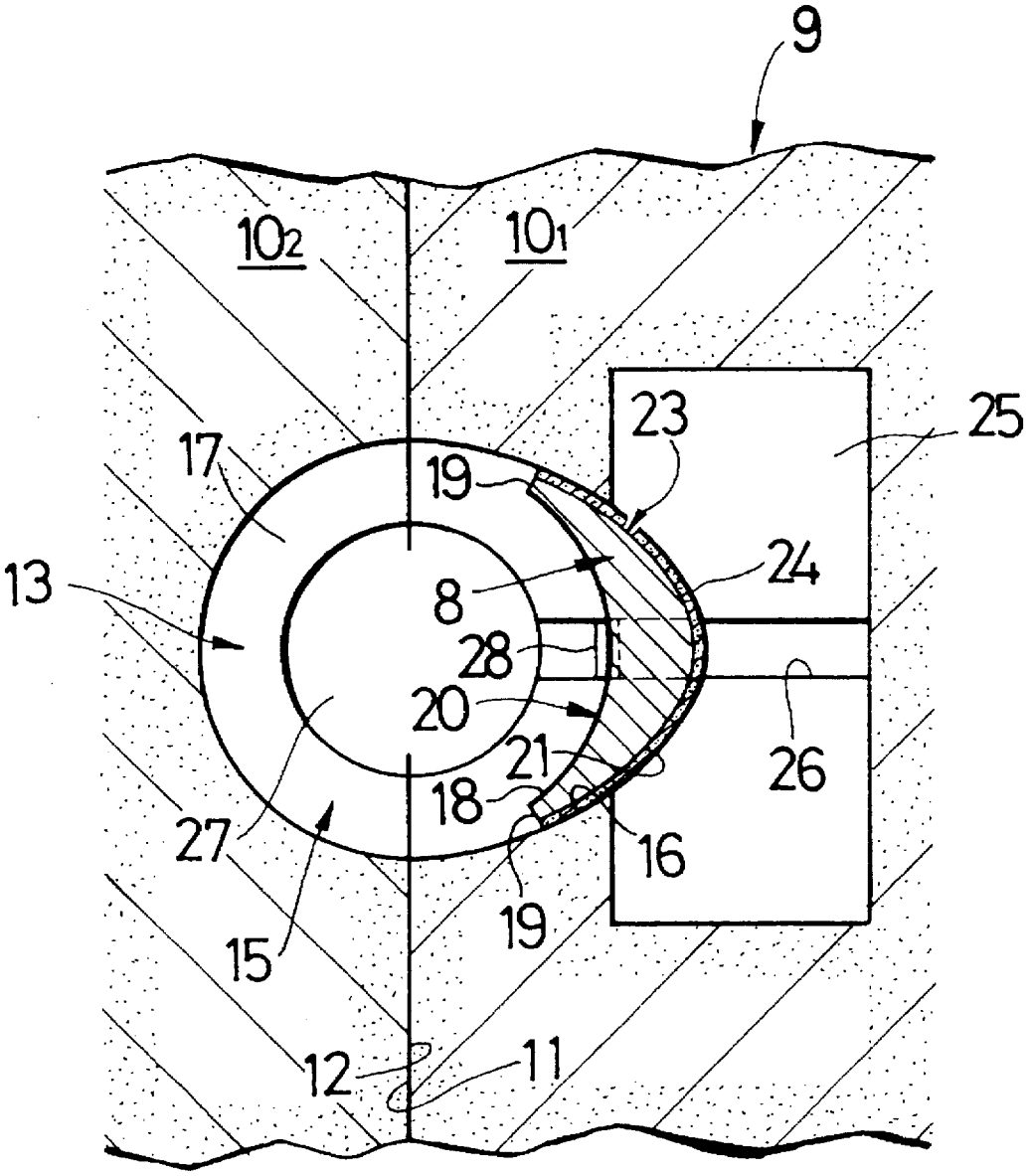
FIG. 5 is a sectional view taken along a line 5—5 in FIG. 4.
Figure 6:
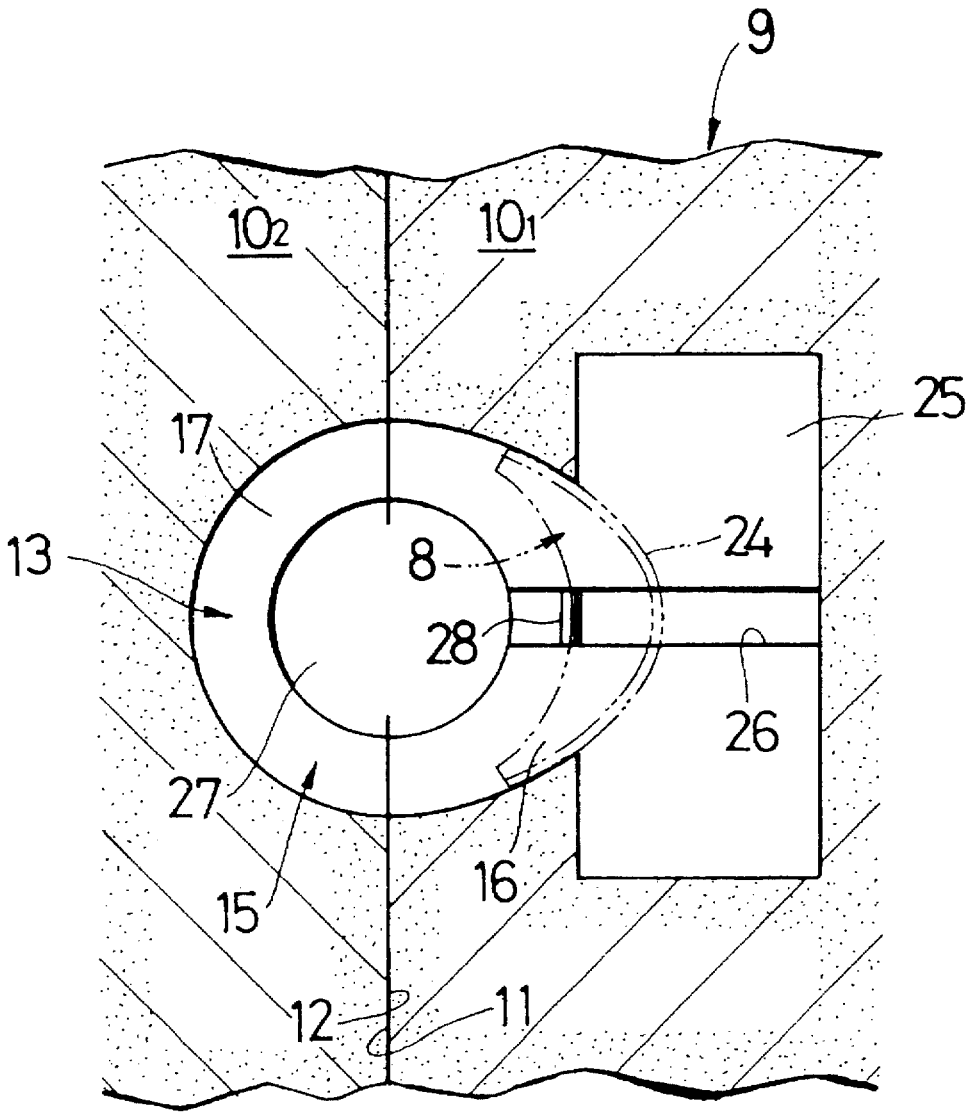
FIG. 6 is a sectional view taken along a line 6—6 in FIG. 4.
Figure 7:
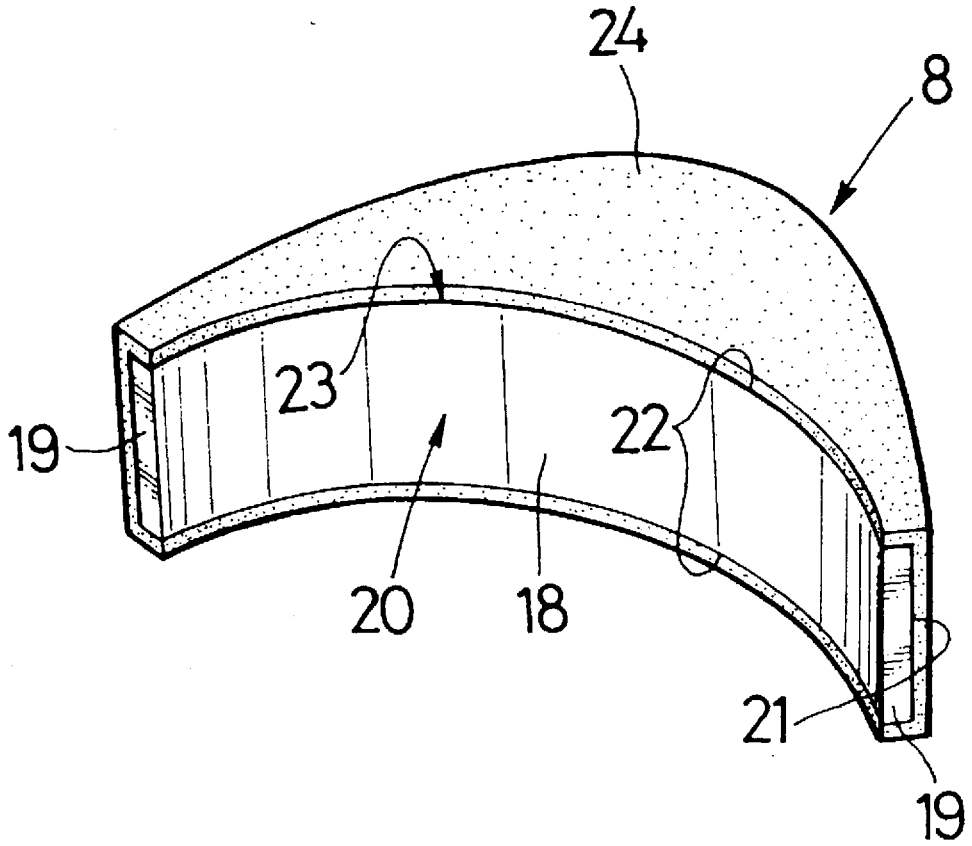
FIG. 7 is a perspective view of a sinter having a barrier layer.

As best shown in FIGS. 4 to 6, the crescent-shaped sinter 8 constituting the nose portion 7 is placed into a nose portion-correspondence zone 16 in each of the cam forming areas 15 in the cavity 13. Referring also to FIG. 7, a concave arcuate inner peripheral surface 18 facing a base circle-portion forming zone 17 and opposite end faces 19 connected to the inner peripheral surface 18 constitute a deposited surface 20. A convex arcuate outer peripheral surface 21 and crescent-shaped opposite end faces 22 constitute a non-deposited surface 23. A barrier layer 24 is formed on the non-deposited face 23 for inhibiting the deposition of a molten metal to the non-deposited surface 23. The formation of the barrier layer 24 will be described hereinafter.

A heating chamber 25 is defined in the shell casting mold 9 around an outer peripheral surface of the barrier layer 24 to face a top portion and opposite side portions of the barrier layer 24. A single communication groove 26 is provided in the shell casting mold 9 to communicate with the cavity 13 and the heating chamber 25. The communication groove 26 extends from the shaft forming zone 27 located just below the base circle-portion forming zone 17 via the base circle-portion forming zone 17 and the nose portion-correspondence zone 16 to the heating chamber 25, and opens into these zones 17 and 16 and into a bottom surface of the heating chamber 25. A small projection 28 of an angle-shape in section is formed on a bottom surface of the communication groove 26 to intersect a longitudinal direction of such bottom surface. The small projection 28 is disposed such that its ridge-line is opposed to a lower edge of the concave arcuate inner peripheral surface 18 of the sinter 8, namely, an inner peripheral edge of the barrier layer 24.

The formation of the barrier layer 24 on the sinter 8 is carried out in the following manner.

Figure 8A:
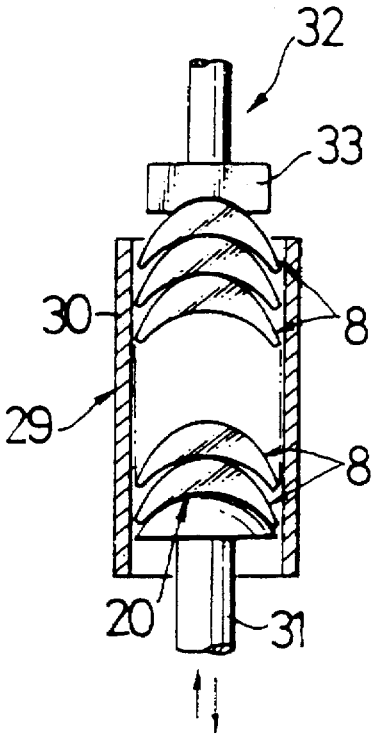
FIGS. 8*a*, 8*b*, 8*c* and 8*d* are diagrams for explaining a method of forming a barrier layer.

As shown in FIG. 8*a*, a plurality of sinters 8 are stacked on a liftable member 31 with their deposited faces 20 turned downwardly, and the uppermost sinter 8 is attracted to an electromagnet 33 of a transporting member 32.

Figure 8B:
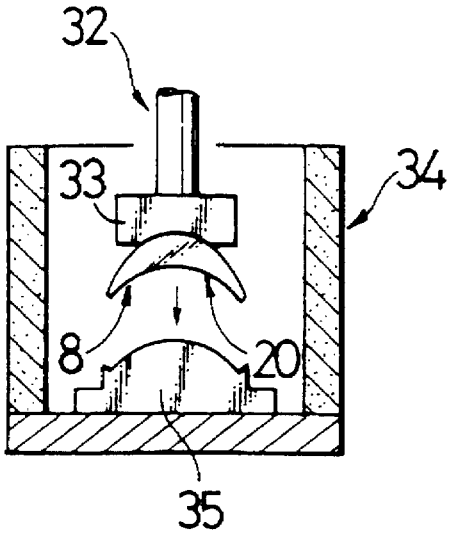

As shown in FIG. 8*b*, the sinter 8 is transported by the transporting member 32 to a firing furnace 34 and then placed onto an upper surface of a lower die 35. In this case, the deposited surface 20 of the sinter 8 comes into a close contact with the upper surface of the lower die 35.

Figure 8C:
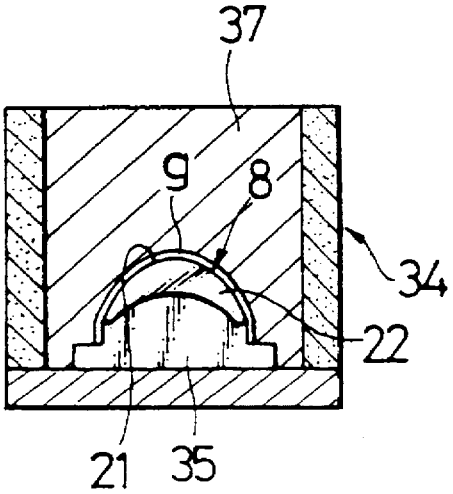

As shown in FIG. 8*c*, an upper die 37 is placed onto the lower die 35 to cover the sinter 8. In this case, a predetermined gap g is defined between the inner peripheral surface and opposite inner end faces of the upper die 37 and the convex arcuate outer peripheral surface 21 and the opposite end faces 22 of the sinter 8.

Figure 8D:
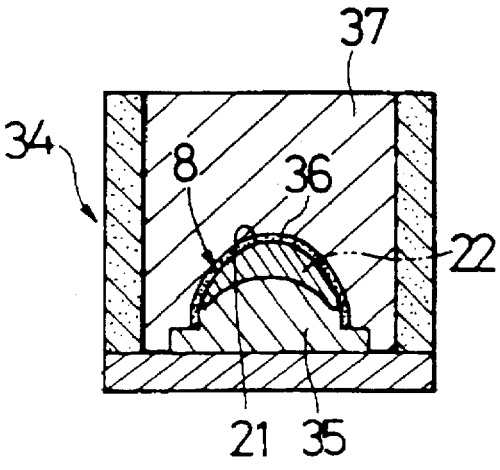

As shown in FIG. 8*d*, a resin-coated sand 36 as a material for forming a barrier layer 24 is blown and filled into the gap g. Then, the layer of the resin-coated sand 36 is fired for 1 minute at 300° C. to provide a barrier layer 24.

The sinter 8 having the barrier layer 24 is placed in the nose portion-correspondence zone 16 in a condition in which the first and second dies $\mathbf{10}_1$ and $\mathbf{10}_2$ have been opened. Therefore, the base circle-portion forming zone 17 has been formed to have an increased volume in accordance with the thickness of the barrier layer 24, as compared with the volume of the base circle-portion 5 resulting from the machining.

After the sinter 8 is placed in the nose portion-correspondence zone 16 in the above-described manner, the molten metal having an alloy cast iron composition is poured into the cavity 13 through the gate 14. The molten metal fills the cavity 13 from the lower portion of the cavity 13.

During casting, a portion of the molten metal is introduced via each of the communication grooves 26 into each of the heating chambers 25 to fill the heating chamber 25 while coming into contact with the barrier layer 24. This causes each of the sinters 8 to be heated from the side of the base circle-portion forming zone 17 and the side of the heating chamber 25, and thus from both of the sides of the deposited surface and the non-deposited surface 23, so that the sinter 8 can rapidly and sufficiently be heated and maintained in a high temperature state for a predetermined time.

The strength of deposition between each of the base circle-portions 5 and each of the sinters 8 can be enhanced by the above-described measure.

In this case, in each of the sinters 8, the barrier layer 24 exists on the non-deposited surface 23 opposed to the heating chamber 25 and the communication groove 26 and therefore, the deposition of the molten metal to the non-deposited surface 23 is avoided by the barrier layer 24.

Figure 9:
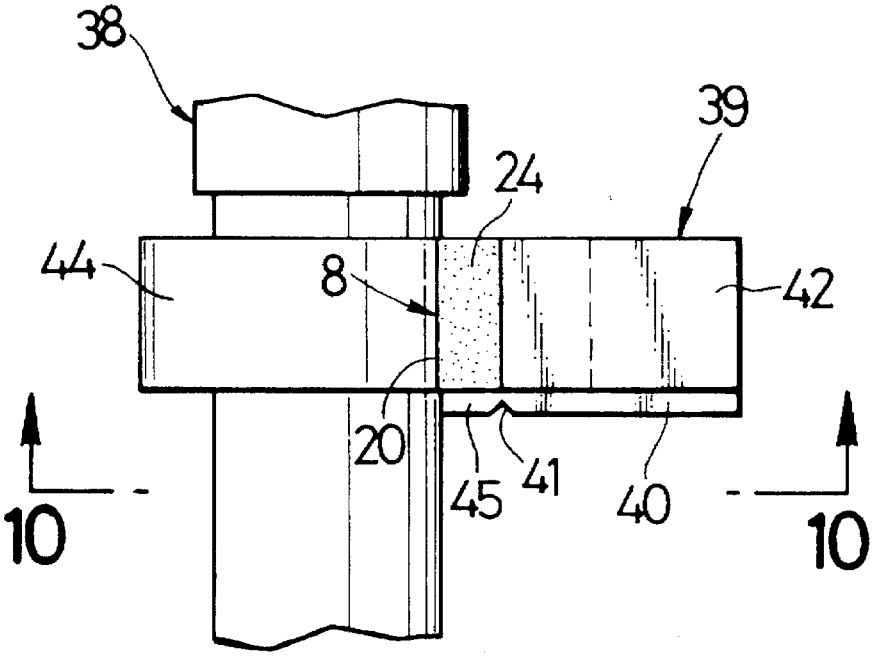
FIG. 9 is a front view of an essential portion of a cam shaft blank.
Figure 10:
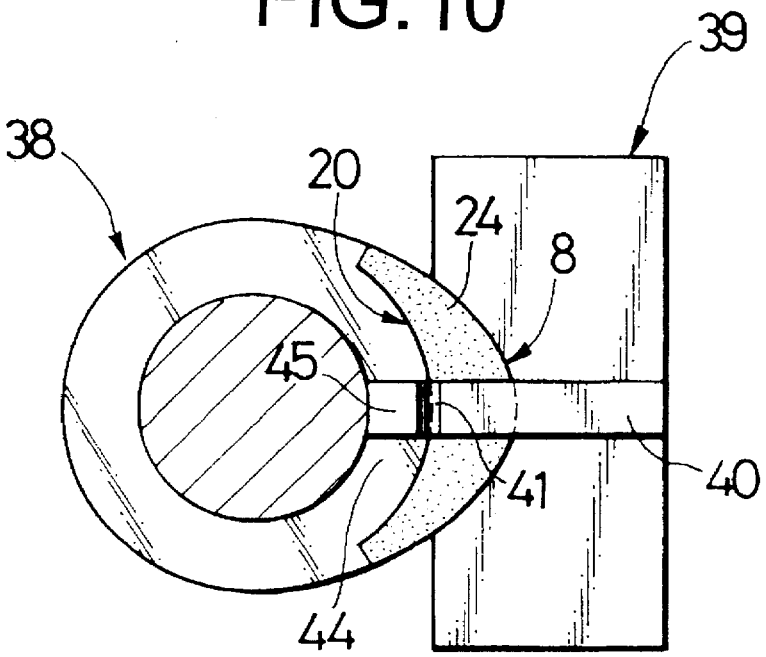
FIG. 10 is a sectional view taken along a line 10—10 in FIG. 9.

Thereafter, the shell casting mold 9 is broken to provide a cam shaft blank 38 shown in FIGS. 9 and 10. A scrap portion 39 corresponding to each of the heating chamber 25 and each of the communication grooves 26 is adhered to the cam shaft blank 38. A notch 41 is formed in a communication groove-correspondence area 40 of the scrap portion 39 by the small projection 28. Thereupon, if a heating chamber-correspondence area 42 of each scrap portion 39 is struck by a hammer or the like, the scrap portion 39 is broken at the notch 41 and separated away from the sinter 8 at a position corresponding to the barrier layer 24.

The cam shaft blank 38 is subjected to a chipping for removal of the barrier layer 24, removal of the scrap portion corresponding to the gate 14 and the like, and then subjected to a preselected machining.

In this case, it is possible to reduce the number of steps and the time required for the post-casting-treatment of the cam shaft blank 38, thereby enhancing the mass-productivity of the cam shaft 1, because the deposition of the molten metal to the non-deposited surface 23 is reliably avoided by the barrier layer 24.

Table 1 shows the composition and hardness $H_RC$ of an alloy cast iron for forming the cam shaft body 6 and a particle-dispersed alloy cast iron for forming each of the sinters 8.

TABLE 1

| | Chemical constituents (% by weight) | | | | | | | | | | Hardness |
|---|---|---|---|---|---|---|---|---|---|---|---|
| | C | Si | Mn | Cr | Mo | Ni | P | V | TiN | Fe | $H_RC$ |
| Alloy cast iron | 3.2 | 1.0 | 0.6 | 0.2 | 0.3 | — | — | — | — | balance | 21–29 |
| Particle-dispersed alloy cast iron (cam body shaft sinter) | 3.0 | 0.5 | 0.3 | 12.0 | 2.0 | 3.0 | 0.6 | 2.2 | 1.0 | balance | 53–65 |

In the cam shaft blank 38 having the composition shown in Table 1, on the assumption that a relation, $W_2=0.2\ W_1$ is established between a weight $W_1$ of the base circle-portion correspondence area 44 and a weight $W_2$ of the sinter 8, a relationship between a deposition rate R of the sinter 8 and a ratio $W_3/W_1$ of the weight $W_3$ of the heating chamber correspondence area 42 to the weight $W_1$ of the base circle-portion correspondence area 44 was determined, and results as shown in Table 2 were obtained.

The pouring temperature of the molten metal having the alloy cast iron composition was set at 1440° C., and the thickness of the barrier layer 24 was set at about 2 mm. Further, the deposition rate R was determined according to an equation of $R=(b/a)\times 100$ (%), wherein a represents an area of the deposited surface 20 of the sinter 8, and b represents an area of the deposited surface 20 deposited to the base circle-portion correspondence area 44.

TABLE 2

| Ratio $W_3/W_1$ | Deposition reate R (%) |
|---|---|
| 0.5 | 40 |
| 1.0 | 60 |
| 1.5 | 85 |
| 2.0 | 100 |
| 2.5 | 100 |

As apparent from Table 2, if the ratio $W_3/W_1$ is set in a range of $W_3/W_1 \geqq 2.0$, the sinter 8 can be completely deposited to the base circle-portion correspondence area 44.

Figure 11:
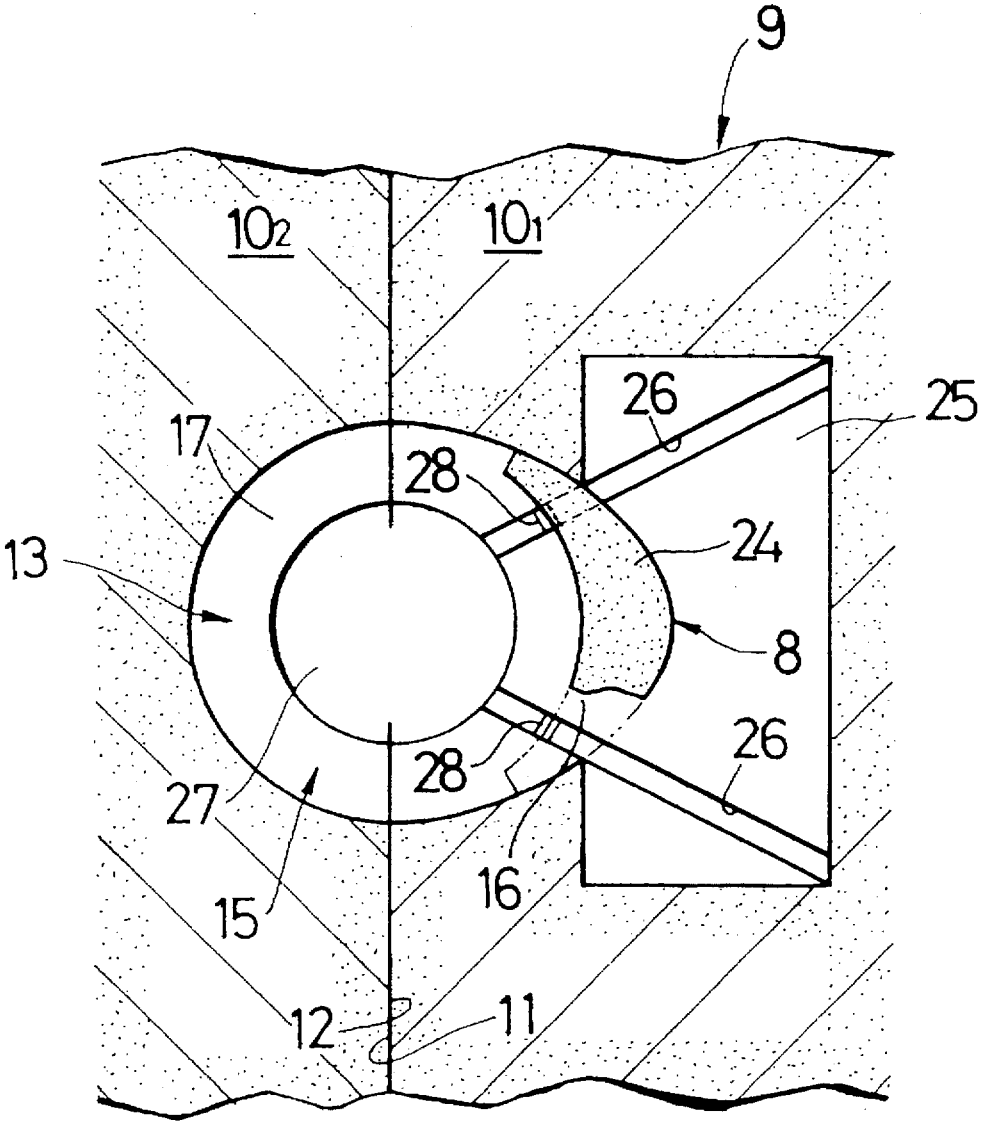
FIG. 11 is a cross-sectional view of a second example of a shell casting mold, similar to FIG. 5.

FIG. 11 shows an example of a shell casting mold 9 in which two communication grooves 26 are provided to communicate with each of heating chambers 25. In this case, the sectional area of each communication groove 26 may be set at one half of that in the above-described example of the shell casting mold 9 and hence, the breaking of the communication groove correspondence area 40 of the scrap portion 39 can be further facilitated.

Figure 12:
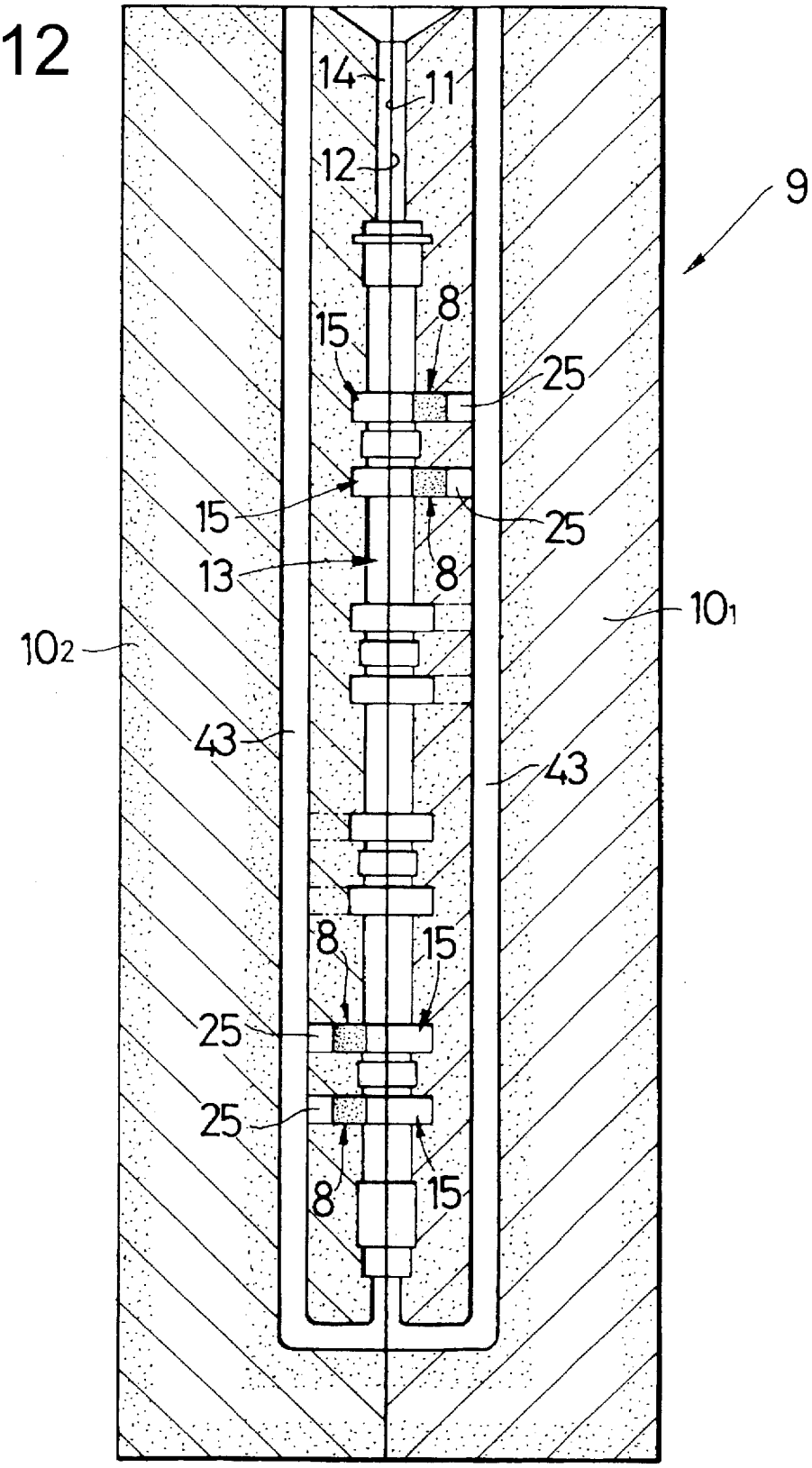
FIG. 12 is a vertical sectional front view of a third example of a shell casting mold.

FIG. 12 shows an example of a shell casting mold 9 in which two runners 43 are provided, such that their lower ends communicate with a lower end of a cam shaft blank forming cavity 13 which is interposed between the two runners 43, and each of the runners 43 communicates with corresponding heating chambers 25. In this case, there is an advantage that the portion 45 of communication groove correspondence area 40 of a scrap portion 39 shown in the examples of FIGS. 9 and 10 is not left on each of base circle-portion correspondence areas 44 of a cam shaft blank 38.

In the above-described embodiments, a deposition promoting layer such as the tin deposit layer or the like is provided on a deposited surface 20 of the sinter 8, whereby the temperature of a molten metal can be lowered to enable the deposition of the low-temperature molten metal to the sinter 8. It is also possible to introduce the low-temperature molten metal into the heating chamber 25 to heat the sinter 8 also from the side of its non-deposited surface 23. In this case, the low-temperature molten metal is not deposited to the non-deposited surface 23 of the sinter 8 and hence, the barrier layer 24 is not required. Further, the deposition of the molten metal to the non-deposited surface 23 can be also avoided by employing a measure that a cast is used as a cast-in insert member, and the non-deposited surface 23 is left as a mill scale, or a measure that a longer communication groove 26 is provided, so that a molten metal is introduced into the heating chamber 25 after its temperature is lowered. Even in these cases, the barrier layer 24 is, of course, not required.

In placing the sinter 8 into the shell casting mold, a cartridge type disclosed in Japanese Patent Application Laid-open No. 195167/95 may be employed in some cases. The present invention is not limited to a cast-in insert process for the cam shaft.

What is claimed is:

1. A method of producing a casted product made up of a casted part and a cast-in insert member, wherein said cast-in insert member is firmly attached to said casted part by a high strength joint, comprising the steps of:

providing a casting mold including a pair of split dies which have at least one cast forming cavity;

providing at least one cast-in insert member, wherein said at least one cast-in insert member has a deposited surface part and a non-deposited surface part;

placing said at least one cast-in insert member into said cast forming cavity of said casting mold; and conducting a casting comprising the steps of:

introducing a molten metal toward said deposited surface part of said at least one cast-in insert member and feeding at least part of said molten metal having been introduced toward said deposited surface part to said non-deposited surface part of said at least one cast-in insert member, thereby heating said at least one cast-in insert member from a side of said deposited surface part and a side of said non-deposited surface part of said at least one cast-in insert member in order to rapidly and sufficiently heat said at least one cast-in insert member so that said high strength joint is formed at an intersection between said deposited surface part of said at least one cast-in insert member and said casted part; and letting said molten metal cool to harden and form said casted product wherein said at least one cast-in insert member is firmly attached to said casted part by means of said high strength joint.

2. The method as in claim 1, wherein said step of providing a casting mold includes providing a casting mold which has a plurality of cast forming cavities.

3. The method as in claim 2, wherein said step of providing at least one cast-in insert member includes providing a plurality of cast-in insert members.

4. The method as in claim 3, wherein said placing step includes placing said plurality of cast-in members into said plurality of cast forming cavities.

5. The method as in claim 4, wherein said casting step includes forming said casted product with a plurality of high strength joints where said plurality of cast-in members are firmly attached to said casted part.

6. The method as in claim 1, wherein a tin layer is coated on said deposited surface part, said tin layer being used for promoting deposition of said molten metal on said deposited surface part and lowering a temperature of said molten metal in contact with said tin layer thereby to prevent deposition of said at least part of said molten metal from being deposited on said non-deposited surface part.

7. The method as in claim 1, wherein a portion of said at least one cast forming cavity adjacent said deposited surface part of said at least one cast-in member is connected to a space formed surrounding said non-deposited surface part through an elongated passage means.

8. The method as in claim 1, wherein said at least one cast-in insert member has a wall of a non-uniform thickness and wherein a portion of said at least one cast forming cavity adjacent said deposited surface part of said at least one cast-in insert member is connected to a space formed surrounding said non-deposited surface part through a passage means, said passage means being located adjacent a portion of said at least one cast-in insert member having a larger thickness than a remaining portion of said at least one cast-in insert member.

9. The method as in claim 1, wherein said at least part of molten metal hits upon said deposited surface part of said at least one cast-in insert member and then flows to a side of said non-deposited surface part of said at least one cast-in insert member.

10. A method of producing a casted product made up of a casted part and a cast-in insert member, wherein said cast-in insert member is firmly attached to said casted part by a high strength joint, comprising the steps of:

providing a casting mold including a pair of split dies which have at least one cast forming cavity;

providing at least one cast-in insert member, wherein said at least one cast-in insert member has deposited surface part and a non-deposited surface part and wherein said at least one cast-in insert member is provided at said non-deposited surface part thereof with a barrier layer for inhibiting deposition of a molten metal to said non-deposited surface part;

placing said at least one cast-in member into said cast forming cavity in said casting mold; and conducting a casting comprising the steps of:

introducing said molten metal toward said deposited surface part of said at least one cast-in insert member and feeding at least part of said molten metal having been introduced toward said deposited surface part to a side of said barrier layer to come into contact with said barrier layer, thereby heating said at least one cast-in insert member from a side of said deposited surface part and a side of said non-deposited surface part of said at least one cast-in insert member in order to rapidly and sufficiently heat said cast-in insert member so that said high strength joint is formed at an intersection between said deposited surface part of said cast-in insert member and said casted product; and letting said molten metal cool to harden and form said casted product wherein said cast-in insert member is firmly attached to said casted part by means of said high strength joint.

11. The method as in claim 10, wherein said barrier layer is formed using a resin layer coated with sand.

12. The method as in claim 11, wherein said step of providing a casting mold includes providing a casting mold which has a plurality of cast forming cavities.

13. The method as in claim 12, wherein said step of providing at least one cast-in insert member includes providing a plurality of cast-in insert members.

14. The method as in claim 13, wherein said placing step includes placing said plurality of cast-in members into said plurality of cast forming cavities.

15. The method as in claim 14, wherein said casting step includes forming said casted product with a plurality of high strength joints where said plurality of cast-in members are firmly attached to said casted part.

16. The method as in claim 10, wherein said at least part of molten metal hits upon said deposited surface part of said at least one cast-in insert member and then flows to a side of said non-deposited surface part of said at least one cast-in insert member.

* * * * *

UNITED STATES PATENT AND TRADEMARK OFFICE

CERTIFICATE OF CORRECTION

PATENT NO. : 5,676,192
DATED : October 14, 1997
INVENTOR(S) : ITABASHI et al.

It is certified that error appears in the above-identified patent and that said Letters Patent is hereby corrected as shown below:

TITLE PAGE:

Item [73], Assignee: "Kabushiki Kaisha Riken, Tokyo, Japan" should read --Kabushiki Kaisha Riken, Tokyo, Japan; and Honda Giken Kogyo Kabushiki Kaisha, Tokyo, Japan--.

Signed and Sealed this

Fourteenth Day of April, 1998

Bruce Lehman

*Attest:*

BRUCE LEHMAN

*Attesting Officer*

*Commissioner of Patents and Trademarks*